US007676879B1

(12) United States Patent
Rutenberg et al.

(10) Patent No.: US 7,676,879 B1
(45) Date of Patent: Mar. 16, 2010

(54) BATTERY-POWERED SEWER AND DRAIN CLEANER

(76) Inventors: Keith H. Rutenberg, 516 S. Post Oak La., #16, Houston, TX (US) 77056; John A. Kline, 2220 Nantucket, Houston, TX (US) 77057

( * ) Notice: Subject to any disclaimer, the term of this patent is extended or adjusted under 35 U.S.C. 154(b) by 737 days.

(21) Appl. No.: 11/651,758

(22) Filed: Jan. 9, 2007

Related U.S. Application Data

(63) Continuation-in-part of application No. 10/624,360, filed on Jul. 22, 2003, now abandoned.

(51) Int. Cl.
*B08B 9/02* (2006.01)

(52) U.S. Cl. ..... 15/104.33; 15/104.31

(58) Field of Classification Search ..... 15/104.31, 15/104.33
See application file for complete search history.

(56) References Cited

U.S. PATENT DOCUMENTS 2,297,755 A * 10/1942 Faust ..... 15/104.33
2,467,849 A * 4/1949 O'Brien et al. ..... 15/104.33
2,730,740 A * 1/1956 O'Brien ..... 15/104.33
4,218,802 A * 8/1980 Babb et al. ..... 15/104.33
D271,436 S * 11/1983 Babb et al. ..... D32/14
4,763,374 A * 8/1988 Kaye ..... 15/104.33
4,793,017 A * 12/1988 Kaye ..... 15/104.33
4,839,936 A * 6/1989 Prange ..... 15/104.33
D312,900 S * 12/1990 Russell et al. ..... D32/14
5,107,550 A * 4/1992 Hawro ..... 4/255.08
5,226,207 A * 7/1993 Elzaurdia ..... 15/104.31
5,309,595 A * 5/1994 Salecker et al. ..... 15/104.33
6,448,732 B1 * 9/2002 Block ..... 318/635

* cited by examiner

*Primary Examiner*—Randall Chin
(74) *Attorney, Agent, or Firm*—Dennis L. Thomte; Thomte Patent Law Office LLC

(57) ABSTRACT

A battery-powered sewer and drain cleaner comprising a frame, a rotatable drum mounted on the frame which has a flexible plumber's snake associated therewith, a DC motor mounted on the frame for driving the drum and a rechargeable battery mounted on the frame for powering the DC motor. A control is connected to the DC motor for controlling the operation thereof. The use of DC power for the cleaner eliminates the electrocution hazard associated with AC-driven sewer and drain cleaners and eliminates the need for an extension cord. The sewer and drain cleaner of this invention includes new and unique circuitry to bypass the motor high current demand around the more delicate circuitry.

14 Claims, 3 Drawing Sheets

BATTERY-POWERED SEWER AND DRAIN CLEANER

CROSS-REFERENCE TO RELATED APPLICATION

This is a continuation-in-part application of application Ser. No. 10/624,360 filed Jul. 22, 2003, now abandoned, entitled "A BATTERY-POWERED SEWER AND DRAIN CLEANER".

BACKGROUND OF THE INVENTION

1. Field of the Invention

This invention relates to a sewer and drain cleaner and more particularly to a battery-powered sewer and drain cleaner.

2. Description of the Related Art

Sewer and drain cleaners are normally hand-driven or electrically driven. The professional grade sewer and drain cleaners are normally powered by an alternating current (AC) electric motor. The sewer and drain cleaners used by plumbers are normally used in wet conditions since the sewer and drain cleaners are not normally used unless there has been a sewer or drain backup or the like. Normally, a plumber will use an extension cord which extends from the AC electric motor on the cleaner to an electrical outlet. Frequently, the electrical extension cord comes into contact with water thereby posing an extremely dangerous electrical shock hazard. Many plumbers are electrocuted annually when the electrically driven sewer and drain cleaners are used in such wet conditions.

Sewer machines require unusually high torque motors in a compact package to accomplish their intended tasks in a normal work environment which requires easily transportable, lightweight machinery handled by a single operator.

There is no prior art for sewer cleaning machines suggesting alternatives to high voltage AC motors for the high torque required that can alleviate problems of inconvenience, lack of portability and danger of electrical shock and electrocution of said high voltage AC motors.

Though many AC appliances have been converted to DC battery power over the years, the unusually high torque requirements of sewer cleaning machines and DC motors which can provide the required torque have a host of inherent problems that have not been solved in the prior art. Such problems include, among others, damaging high inrush current on motor startup that can potentially destroy the very electrical components of the power and control circuitry that start, stop, reverse and otherwise control the motor itself. The advantages of battery-powered, DC operation have not been realized since the damage induced by the high inrush current has not previously been overcome until this invention.

SUMMARY OF THE INVENTION

A battery-powered sewer and drain cleaner is disclosed which is essentially the same as a professional grade sewer and drain cleaner except that the motor on the cleaner of this invention is a DC electric motor and is driven by a battery associated therewith. The cleaner comprises a wheeled or wheelers frame having a rotatable drum mounted thereon which is driven by a battery-powered DC motor through either a belt or chain drive or a gear direct drive. A flexible plumber's snake is conventionally associated with the rotatable drum. The fact that the sewer and drain cleaner of this invention is DC battery-powered eliminates the need for extension cords and eliminates the electrocution hazard normally associated with electrically driven sewer and drain cleaners. The sewer and drain cleaner of this invention includes circuitry which overcomes the damaging effect of high inrush current associated with high torque DC motors to protect electrical components in the control circuitry.

It is therefore a principal object of the invention to provide a sewer and drain cleaner which is battery-powered.

Still another object of the invention is to provide a sewer and drain cleaner which is powered by a DC motor operated by a battery.

Still another object of the invention is to provide a battery-powered sewer and drain cleaner which eliminates the need for extension cords.

Still another object of the invention is the use of unique wiring and circuitry to overcome the damaging effect of the unusually high inrush current of high torque DC motors on electrical components in the control circuitry.

Still another object of the invention is to provide a new and unique circuit including a contactor in the current flow path to allow the high current demand of the high torque DC motors to bypass the more delicate control circuitry.

Yet another object of the invention is to provide a battery-powered sewer and drain cleaner which eliminates the electrocution hazard normally associated with electrically operated sewer and drain cleaners.

These and other objects will be apparent to those skilled in the art.

DESCRIPTION OF THE PREFERRED EMBODIMENT

Figure 2:
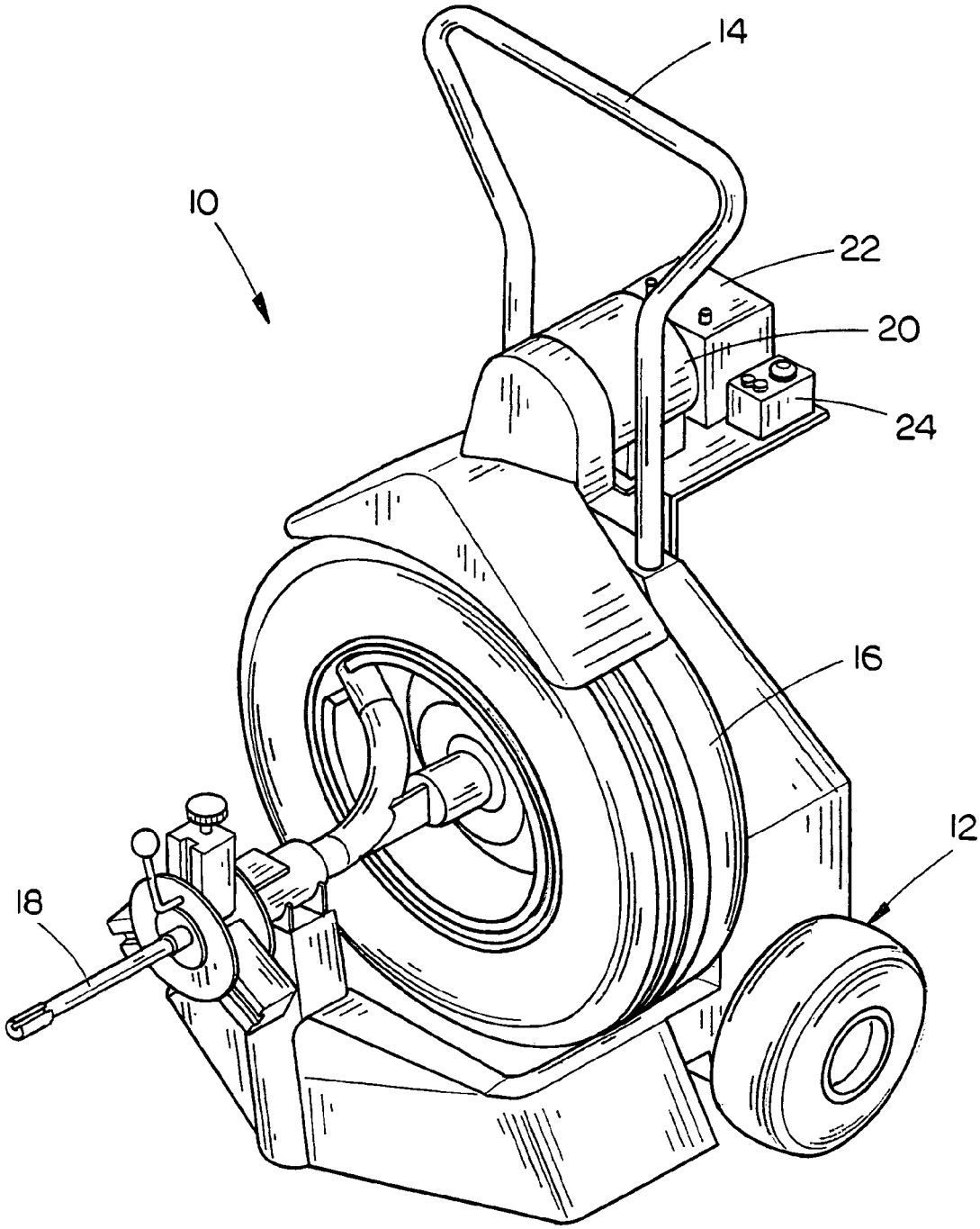
FIG. 2 is a perspective view of another embodiment of this invention wherein the motor thereon is connected to the rotatable drum by a belt or chain drive.

Referring to FIG. 2, the sewer and drain cleaner of this invention is referred to generally by the reference numeral 10. Cleaner 10 includes a wheeled frame 12 which is manipulated through the use of a handle 14. Although the frame of the cleaner is preferably of the wheeled type, the wheels thereof could be omitted. The cleaner 10 in FIG. 2 is conventional in design except for the motive force and the structure associated therewith. Cleaner 10 is of the belt or chain-driven type and includes a rotatable drum 16 having a conventional plumber's snake 18 associated therewith. Normally, the drum 16 and the snake 18 would be operated by an AC motor with the attendant electrocution hazard associated therewith. In the cleaner of FIG. 2, the AC motor has been replaced by a DC motor 20. Applicants have determined that 36-volt DC motors work satisfactorily. Preferably, the motor 20 is high speed and high torque. However, the main criteria are that the motor have sufficient torque and shaft speed to rotate the drum at 230-350 RPM. Motor 20 is driven by a rechargeable and/or disposable DC battery 22. The motor 20 is controlled by means of a control circuit 24 which preferably includes a motor and voltage control associated therewith. Preferably, the battery 22 is of the battery pack design which may be easily removed from the cleaner for recharging purposes.

Figure 3:
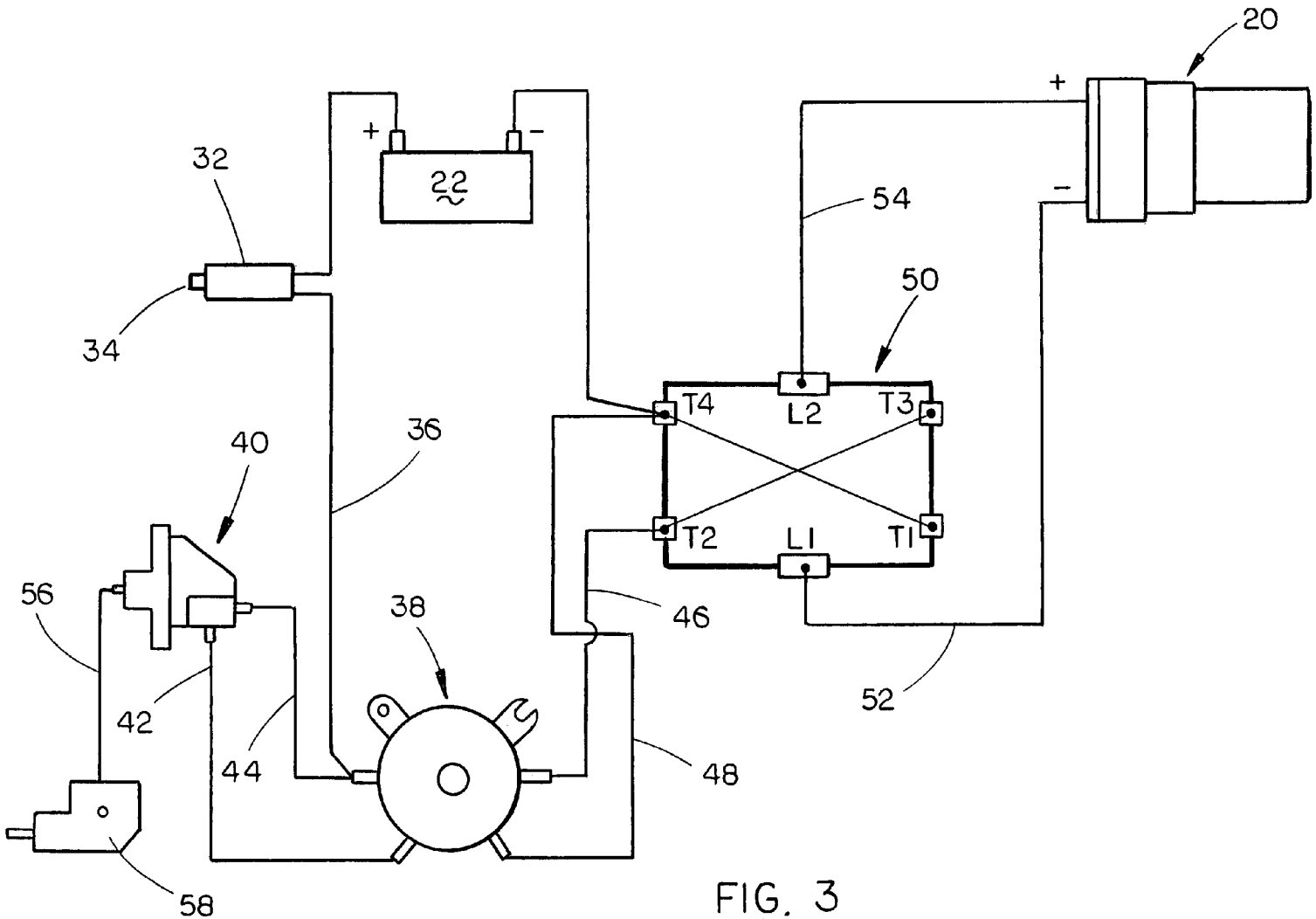
FIG. 3 is a schematic of the circuitry of this invention.

As seen in FIG. 3, the positive terminal of the battery 22 is connected to one side of a 30-amp breaker 32 having a reset 34. Breaker 32 has a lead 36 which is connected to a contactor 38 such as a Stancor™ 70-904 contactor. The numeral 40 refers to an air switch having leads 42 and 44 extending therefrom which are connected to contactor 38 as shown.

Leads 46 and 48 extend from contactor 38 to terminals T2 and T4 of a three-way switch 50. Switch 50 has three positions, namely, forward, reverse and neutral. Leads 52 and 54 extend from terminals L1 and L2 of switch 50 to the negative and positive sides of motor 20 as shown. As seen, switch 50 is directly connected to the battery 22, motor 20 and contactor 38 for controlling the forward, neutral and reverse directions of the motor 20.

The contactor 38 absorbs the high inrush of current that is created each time the machine is started. The contactor 38 and its in-line connection to the breaker 32 protects all the electrical components as well as the battery 22. The air switch 40 is connected to the air tube 56 and foot pedal switch 58. When the foot pedal 58 is pushed or depressed, the circuit of the air switch 40 is closed and the entire circuit is then complete. Upon completion of the circuit, the machine begins to move and all the components are activated.

Figure 1:
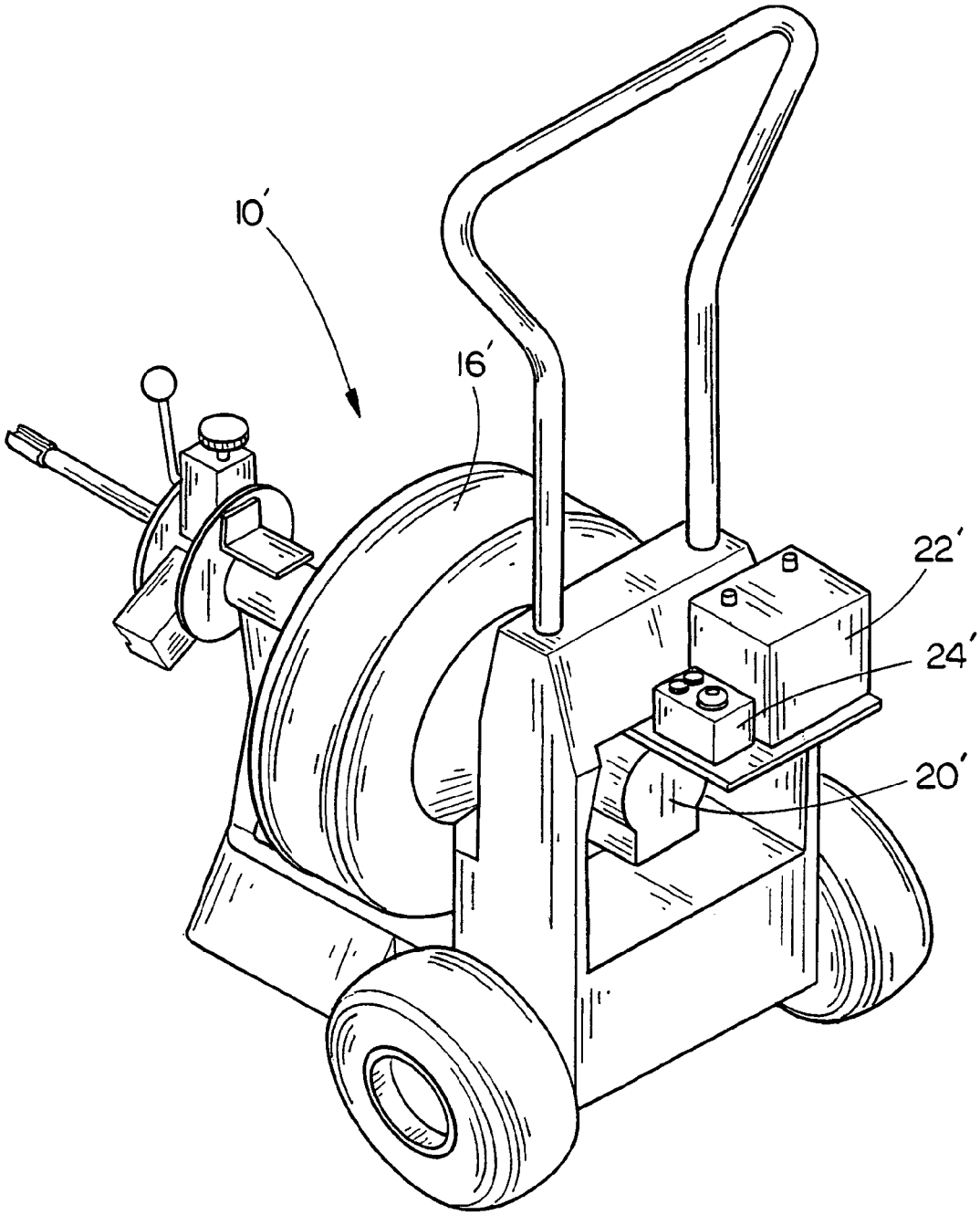
FIG. 1 is a perspective view of one embodiment of this invention which is of the gear direct drive type.

FIG. 1 illustrates a modified form of the cleaner and which is referred to by the reference numeral 10'. Cleaner 10' is identical to the cleaner 10 except that the DC motor 20' is connected to the drum 16' by a gear or belt drive rather than a belt drive. Cleaner 10' includes a battery 22' and control 24'. The cleaner 10' of FIG. 1 operates identically to cleaner 10 except that it is gear or direct drive rather than belt or chain-driven.

The sewer and drain cleaner of this invention eliminates the need for extension cords and eliminates the electrocution hazard normally associated with AC motor-driven sewer and drain cleaners through the use of the DC motor and the battery employed in the instant invention.

The circuitry of the invention includes unique wiring and circuitry which overcomes the damaging effect of the unusually high inrush current associated with high torque DC motors, thereby protecting the electrical components of the machine.

Thus it can be seen that the invention accomplishes at least all of its stated objectives.

We claim:

1. In combination:

a battery-powered sewer and drain cleaner, comprising:

(a) a frame;

(b) a rotatable drum mounted on said frame which has a flexible plumber's snake associated therewith;

(c) a DC motor mounted on said frame; said motor having a driven shaft operatively connected to said drum for rotating the same;

(d) a rechargeable DC battery mounted on said frame for powering said DC motor;

(e) electrical circuitry which controls the operation of the cleaner;

(f) said electrical circuitry including means for preventing the high inrush electrical current of said DC motor from damaging the electrical components of the cleaner.

2. The combination of claim 1 wherein said means for preventing the high inrush electrical current of the said DC motor includes a contactor.

3. The combination of claim 2 wherein said contactor is imposed between the said DC battery and said DC motor.

4. The combination of claim 3 wherein a circuit breaker is imposed between said DC battery and said contactor.

5. The combination of claim 2 wherein said DC battery and said DC motor each have positive and negative terminals, the electrical contactor further including a three-way switch and a circuit breaker having first and second sides, a first lead connecting the positive terminal of said DC battery to one side of said circuit breaker, a second lead connecting the other side of said breaker to said contactor, an air switch connected to said contactor, third and fourth leads connected to said three-way switch, and fifth and sixth leads connecting said three-way switch to said positive and negative terminals of said DC motor, respectively.

6. The combination of claim 2 wherein said DC battery and said DC motor each have positive and negative terminals, the electrical contactor further including a three-way switch and a circuit breaker having first and second sides, a first lead connecting the positive terminal of said DC battery to one side of said circuit breaker, a second lead connecting the other side of said breaker to said contactor, a first switch connected to said contactor, third and fourth leads connected to said three-way switch, and fifth and sixth leads connecting said three-way switch to said positive and negative terminals of said DC motor, respectively.

7. The combination of claim 1 wherein said DC motor is operatively connected to said drum by a belt drive.

8. The combination of claim 1 wherein said DC motor is operatively connected to said drum by a gear drive.

9. The combination of claim 1 wherein said battery comprises a battery pack.

10. The combination of claim 1 wherein said motor comprises a high speed, high torque motor.

11. The combination of claim 1 wherein said motor is a 36-volt DC motor.

12. The combination of claim 1 wherein said circuitry includes a motor and voltage control.

13. The combination of claim 1 wherein said motor has sufficient torque and shaft speed to rotate said drum at approximately 230-350 rpm.

14. The combination of claim 1 wherein said battery is disposable.

* * * * *